US008303784B1

(12) United States Patent
Yang

(10) Patent No.: US 8,303,784 B1
(45) Date of Patent: Nov. 6, 2012

(54) BANDOLEER OF ARTICLE CARRIERS

(75) Inventor: Chih-Lin Yang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 94 days.

(21) Appl. No.: 13/094,810

(22) Filed: Apr. 26, 2011

(51) Int. Cl.

| | |
|---|---|
| ***C25B 9/02*** | (2006.01) |
| ***C25D 17/06*** | (2006.01) |
| ***C25D 17/08*** | (2006.01) |
| ***B25B 5/14*** | (2006.01) |

(52) U.S. Cl. ..... 204/297.16; 269/47; 269/49; 269/50; 269/74; 269/260; 269/315; 269/318; 204/297.01; 204/297.06

(58) Field of Classification Search ..... 204/297.16; 269/47, 49, 50, 74, 260, 315, 318; 205/129, 205/137, 138, 151

See application file for complete search history.

(56) References Cited

U.S. PATENT DOCUMENTS 7,963,798 B1 * 6/2011 Yang ..... 439/567

* cited by examiner

*Primary Examiner* — Bruce Bell
(74) *Attorney, Agent, or Firm* — Cheng-Ju Chiang

(57) ABSTRACT

A bandoleer of article carriers includes a carrier band, and a plurality of carrier racks connected with a bottom edge of the carrier band each by means of a connecting plate and arranged at regular intervals. Each carrier rack shows a substantially inverted-V shape and has a pair of elastic arms extending downward from two ends of a bottom edge of the connecting plate and gradually inclined away from each other. Two distal ends of the elastic arms protrude oppositely to each other to form a pair of hook portions. Upper portions of two opposite side edges of the connecting plate oppositely protrude sideward to form two blocking portions. Lower portions of the two opposite side edges of the connecting plate oppositely protrude sideward and then are bent towards two opposite directions perpendicular to the plane of the connecting plate to form two lying-L shaped resisting portions.

4 Claims, 2 Drawing Sheets

BANDOLEER OF ARTICLE CARRIERS

BACKGROUND OF THE INVENTION

1. Field of the Invention

The present invention relates to an article carrier, and more particularly to a bandoleer of article carriers capable of holding and carrying a plurality of articles for assisting the articles to be plated one after another.

2. The Related Art

A traditional connector shell is often made by means of curving a metal board. Two free ends of the metal board are riveted with each other to make the connector shell show a rectangular tube shape. However, electronic products are demanded with greater and greater precision, so it is preferable to apply no jointing work to the connector shell instead of riveting with the two free ends of the metal board. Then the connector shell is plated in a plating bath. However, the connector shells made by no jointing work are single spare parts. As a result, the connector shells cannot be plated by continuous plating technology when mass-production is needed.

SUMMARY OF THE INVENTION

An object of the present invention is to provide a bandoleer of article carriers which is adapted to hold and carry a plurality of articles to assist the articles to be plated one after another. The bandoleer of article carriers includes a carrier band, and a plurality of carrier racks connected with a bottom edge of the carrier band each by means of a connecting plate and arranged at regular intervals along the carrier band. Each of the carrier racks shows a substantially inverted-V shape and has a pair of elastic arms extending downward from two ends of a bottom edge of the connecting plate and gradually inclined away from each other. Two distal ends of the pair of elastic arms protrude oppositely to each other to form a pair of hook portions. Upper portions of two opposite side edges of the connecting plate oppositely protrude sideward to form a pair of blocking portions. Lower portions of the two opposite side edges of the connecting plate oppositely protrude sideward and then are bent towards two opposite directions perpendicular to the plane of the connecting plate to form a pair of lying-L shaped resisting portions. The carrier rack is inserted downward into the article and then the elastic arms are set free to make the hook portions hooked under the article and the article restrained between the blocking portions and the hook portions. Distal ends of the resisting portions abut against two opposite inner sides of the article, and two opposite outside faces of the resisting portions abut against another two opposite inner sides of the article, so as to further secure the article with the carrier rack.

As described above, based on the structure design of the carrier rack, an operator can use one hand thereof to press the elastic arms towards each other and the other hand thereof to hold the article so as to make the article easily assembled to and taken off from the carrier rack. Furthermore, the blocking portions, the resisting portions and the hook portions can further firmly secure the article to the carrier rack.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 1:
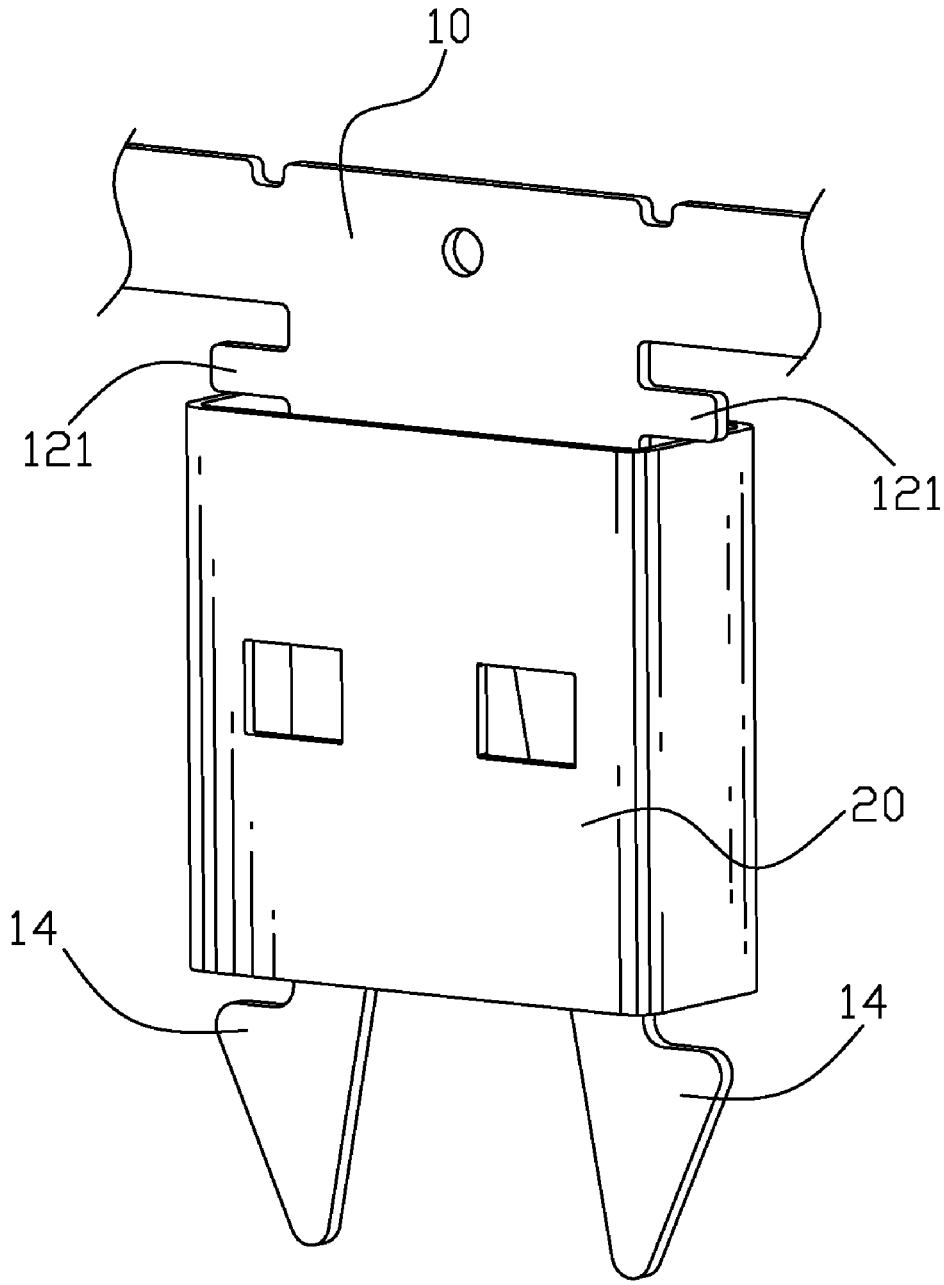
FIG. 1 is an assembled perspective view showing that an article is held to one article carrier of a bandoleer of article carriers according to an embodiment of the present invention.

With reference to FIG. 1, a bandoleer of article carriers according to an embodiment of the present invention is adapted to hold and carry a plurality of articles 20 so as to assist the articles 20 to be plated one after another. In this embodiment, the article 20 is a rectangular tube-shaped connector shell. The bandoleer of article carriers includes a plurality of article carriers 10.

Figure 2:
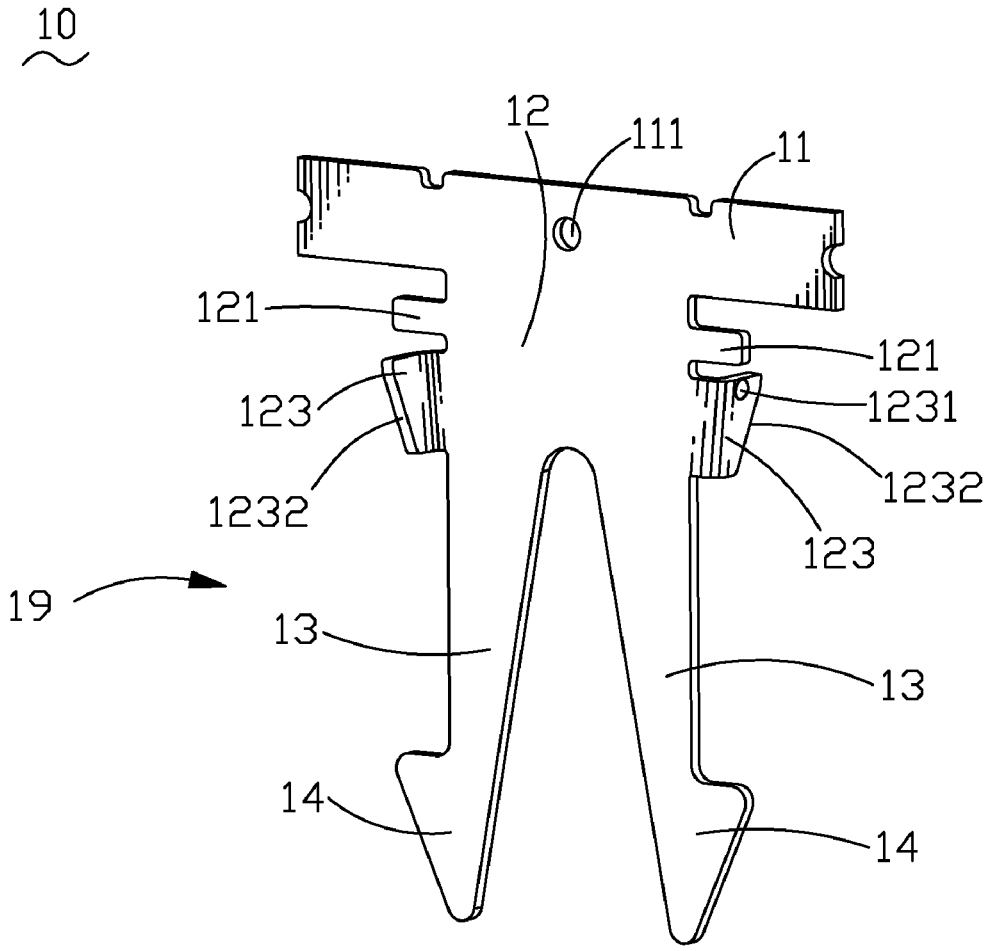
FIG. 2 is a perspective view of the article carrier of the bandoleer of article carriers of FIG. 1.

Referring to FIG. 2, the article carrier 10 has a carrier band 11 and a carrier rack 19 which has a top edge connected with a substantial middle of a bottom edge of the carrier band 11 by means of a rectangular connecting plate 12. Two ends of a bottom edge of the connecting plate 12 extend downward to form a pair of elastic arms 13 gradually inclined away from each other in the process of extending downward to show a substantially inverted-V shape together. Two distal ends of the pair of elastic arms 13 protrude oppositely to each other to form a pair of inverted-triangular hook portions 14. A middle of the carrier band 11 is provided with a hole 111 which is used to count the articles 20 carried by the bandoleer of article carriers. Upper portions of two opposite side edges of the connecting plate 12 protrude oppositely to each other to form a pair of blocking portions 121, and lower portions of the two opposite side edges of the connecting plate 12 protrude oppositely to each other and then are bent towards two opposite directions perpendicular to the plane of the connecting plate 12 to form a pair of lying-L shaped resisting portions 123. A distal end of each of the resisting portions 123 is designed with a guiding slope 1232 gradually approaching the plane of the connecting plate 12 from top to bottom. Tops of two opposite outside faces of the resisting portions 123 oppositely protrude outward to form a pair of bumps 1231.

Referring to FIGS. 1-2 again, when the article 20 are assembled to the article carrier 10, the elastic arms 13 are pressed towards each other by one hand of an operator, to shorten the distance between the two hook portions 14. The other hand of the operator holds the article 20 to make the carrier rack 19 inserted into the article 20 until the article 20 is blocked by the blocking portions 121. At this time, the hook portions 14 project out of the article 20, and the elastic arms 13 are set free to make the hook portions 14 hooked under the article 20. So the article 20 is restrained between the blocking portions 121 and the hook portions 14. The distal ends of the resisting portions 123 abut against two opposite inner sides of the article 20, and the bumps 1231 abut against another two opposite inner sides of the article 20, so as to further secure the article 20 to the carrier rack 19. In the process of the carrier rack 19 being inserted into the article 20, the guiding slopes 1232 of the resisting portions 123 achieve a guiding function on the article 20 so as to facilitate the article 20 to be assembled to the carrier rack 19. Lastly, the article 20 is carried by the carrier band 11 of the article carrier 10 to be processed by plating technology. When the article 20 will be taken off from the article carrier 10, one hand of the operator presses the hook portions 14 towards each other and the other hand of the operator takes off the article 20 from the carrier rack 19.

As described above, based on the structure design of the carrier rack 19, the operator can use one hand thereof to press the elastic arms 13 towards each other and the other hand thereof to hold the article 20 so as to make the article 20 easily assembled to and taken off from the carrier rack 19. Furthermore, the article carrier 10 utilizes the blocking portions 121, the hook portions 14, the resisting portions 123 and the bumps 1231 to firmly secure the article 20 to the carrier rack 19.

What is claimed is:

1. A bandoleer of article carriers adapted to hold and carry a plurality of articles to assist the articles to be plated one after another, the bandoleer of article carriers comprising:

a carrier band; and a plurality of carrier racks connected with a bottom edge of the carrier band each by means of a connecting plate and arranged at regular intervals along the carrier band, each of the carrier racks showing a substantially inverted-V shape and having a pair of elastic arms extending downward from two ends of a bottom edge of the connecting plate and gradually inclined away from each other, two distal ends of the pair of elastic arms protruding oppositely to each other to form a pair of hook portions, upper portions of two opposite side edges of the connecting plate oppositely protruding sideward to form a pair of blocking portions, lower portions of the two opposite side edges of the connecting plate oppositely protruding sideward and then being bent towards two opposite directions perpendicular to the plane of the connecting plate to form a pair of lying-L shaped resisting portions;

wherein the carrier rack is inserted downward into the article and then the elastic arms are set free to make the hook portions hooked under the article and the article restrained between the blocking portions and the hook portions, distal ends of the resisting portions abut against two opposite inner sides of the article, and two opposite outside faces of the resisting portions abut against another two opposite inner sides of the article, so as to further secure the article with the carrier rack.

2. The bandoleer of article carriers as claimed in claim 1, wherein the distal end of each of the resisting portions is designed with a guiding slope gradually approaching the plane of the connecting plate from top to bottom for guiding the article to be assembled to the carrier rack.

3. The bandoleer of article carriers as claimed in claim 1, wherein tops of the two opposite outside faces of the resisting portions oppositely protrude outward to form a pair of bumps abutting against the another two opposite inner sides of the article.

4. The bandoleer of article carriers as claimed in claim 1, wherein the carrier band defines a plurality of holes corresponding to the carrier racks respectively for counting the articles carried by the bandoleer of article carriers.

* * * * *